US008734276B2

(12) United States Patent
Laurienzo et al.

(10) Patent No.: US 8,734,276 B2
(45) Date of Patent: May 27, 2014

(54) TRANSFORMING DART

(71) Applicant: JAKKS Pacific, Inc., Malibu, CA (US)

(72) Inventors: Dominic Laurienzo, Rancho Palos Verdes, CA (US); Rip Lopusnak, Reseda, CA (US); Brandon Giraldez, Marina Del Ray, CA (US); Dennis Lee Chi Wai, Hong Kong (CN); Eli Halpert, Los Angeles, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 0 days.

(21) Appl. No.: 13/626,877

(22) Filed: Sep. 25, 2012

(65) Prior Publication Data

US 2014/0087895 A1 Mar. 27, 2014

(51) Int. Cl.
*A63B 65/02* (2006.01)

(52) U.S. Cl.
USPC ..... 473/578

(58) Field of Classification Search
USPC ..... 473/578, 582, 583
See application file for complete search history.

(56) References Cited

U.S. PATENT DOCUMENTS

| | | | | |
|---|---|---|---|---|
| 4,295,290 | A | 10/1981 | Boswell | |
| 4,770,423 | A | 9/1988 | Pinske | |
| 5,207,434 | A | 5/1993 | Oudekerk | |
| 5,299,966 | A | 4/1994 | Rose, III | |
| 2010/0216579 | A1 | 8/2010 | Williams | |
| 2011/0300975 | A1 * | 12/2011 | Harris et al. | 473/582 |

* cited by examiner

*Primary Examiner* — John Ricci
(74) *Attorney, Agent, or Firm* — Tope-McKay & Associates

(57) ABSTRACT

A transforming dart mechanism is described. The transforming dart mechanism includes an inner collar and an outer collar. A dart body is positioned through the inner collar, while fins are pivotally attached with the outer collar. A deployable canopy is affixed with the fins. Thus, in operation, a user can position the fins and deployable canopy against the dart body in a collapsed state. When in the collapsed state, a user can shoot the toy dart horn a to dart gun and upon contacting a target, the fins and deployable canopy expand into an expanded state.

9 Claims, 3 Drawing Sheets

TRANSFORMING DART

BACKGROUND OF THE INVENTION (1) Field of Invention

The present invention relates to a toy dart and more particularly, to a to dart that transforms from a collapsed state to an expanded state upon hitting a target.

(2) Description of Related Art

Toy darts have long been known in the art. Toy darts typically include an elongated foam body with a suction-cup tip. Pneumatic powered guns or other shooting devices are commonly used to shoot the toy darts at a target Of other item upon which the dart can become attached (via its suction cup). While operable for sticking to their target, traditional toy darts do not provide any enhanced features.

Thus, a continuing need exists for a toy dart that provides enhanced features upon hitting a target.

SUMMARY OF INVENTION

The present invention is directed to a transforming dart mechanism that allows a toy dart to transform from a collapsed state to an expanded state upon hitting a target. In its simplest form, the transforming dart mechanism includes a base adapted to attach with a dart body and an expansion component connected with the base. The expansion component is formed to be positioned in a collapsed state and, upon hitting a target, move into an expanded state.

In another aspect, the expansion component includes a plurality of fins that are pivotally connected with the base. Additionally, a deployable canopy is affixed with the plurality of fins.

In yet another aspect, the base further comprises an inner collar, a spring, and an outer collar. The inner collar has a hole therethrough to accommodate a dart body and further includes a spring recess and a plurality of collar knuckles. The spring is positioned around the spring recess while the outer collar is positioned around the inner collar. Finally, the fins are pivotally connected with the outer collar.

In another aspect, each of the plurality of fins includes a fin knuckle. The fin knuckles are formed to engage with the collar knuckles, such that when the fins are folded back into a collapsed state, the fin knuckles engage with the collar knuckles to force the outer collar back. Thus, when the transforming dart mechanism is shot from a toy dart gun and hits a target, a forward momentum force causes the fins to deploy forward, with the collar knuckles also engaging with the fin knuckles to assist the fins in folding out into the expanded state as the outer collar slides forward.

In yet another aspect, a dart body is positioned through the inner collar, with a dart tip attached with the dart body. The dart tip includes a suction cup and a cap member.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a toy dart and, more particularly, to a toy dart that transforms from a collapsed state to an expanded state upon hitting a target. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1A:
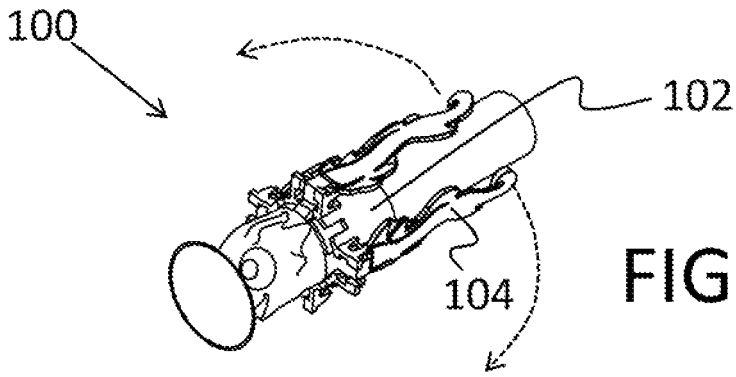
FIG. 1A is an illustration of a transforming dart according to the present invention, depicting the transforming dart in a collapsed state, with the deployable canopy removed for illustrative purposes.
Figure 1B:
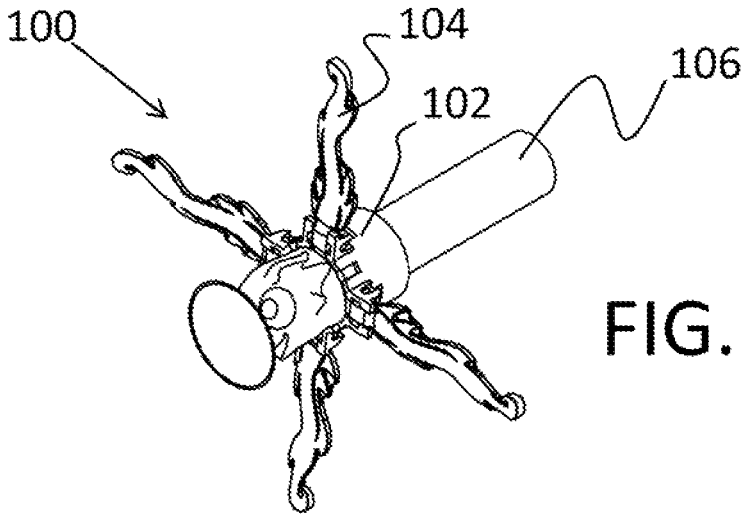
FIG. 1B is an illustration of the transforming dart in an expanded state, with the deployable canopy removed for illustrative purposes.
Figure 1C:
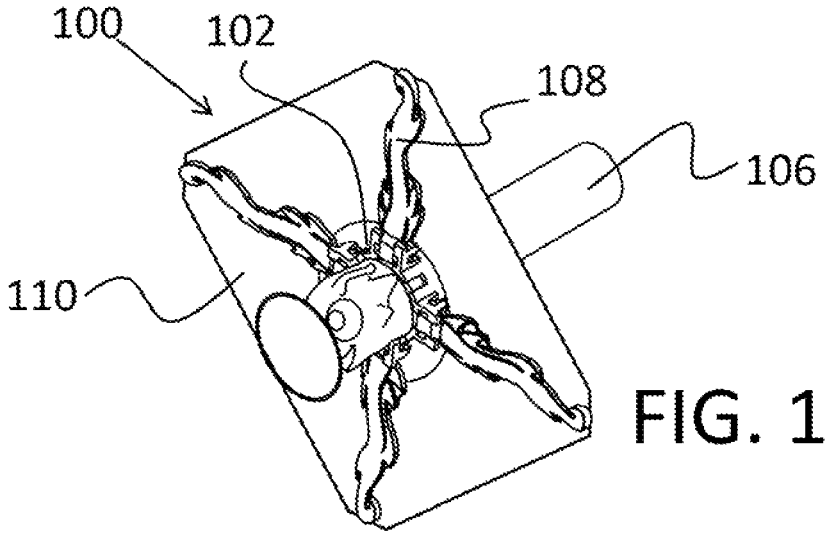
FIG. 1C is an illustration of the transforming dart in an expanded state, depicting the deployable canopy as expanded.

The present invention is directed to a transforming dart device that transforms firma a collapsed state to an expanded state upon hitting a target. As shown in FIGS. 1A through 1C, the transforming dart 100 includes a transforming dart mechanism that allows the dart 100 to transform from the collapsed state (as show in FIG. 1A) into the expanded state (as shown in FIGS. 1B and 1C). The transforming dart mechanism is any suitable mechanism or device that allows for such a transformation. For example, the transforming dart mechanism includes a base 102 and expansion components 104. The base 102 is any suitable mechanism or device that is adapted (e.g., having a hole therethrough) to attach or affix with a dart body 106, while the expansion components 104 are formed to transform between the collapsed and expanded states. Thus, as shown in FIG. 1A, the expansion components 104 are positioned against the dart body 106 and maintained, in a collapsed state. Upon hitting a target, the expansion components 104 are forced to expand into the expanded state (as shown in FIG. 1B).

The expansion components 104 are any suitable mechanism or device that allow for expansion from a collapsed state to an expanded state. As a non-limiting example and as shown in FIG. 1C, the expansion components include fins 108 pivotally attached with the base 102 and a deployable canopy 110 that is affixed with the fins 108. The deployable canopy 110 is affixed with the fins using any suitable mechanism or technique, a non-limiting example of which includes being glued to the fins 108. The deployable canopy 110 is any suitably flexible material, such as plastic. Although the deployable canopy 110 is not depicted in FIG. 1A, one skilled in the art can appreciate that when the fins 108 are in the collapsed state, the deployable canopy 110 would simply fold against the dart body 106.

Figure 2:
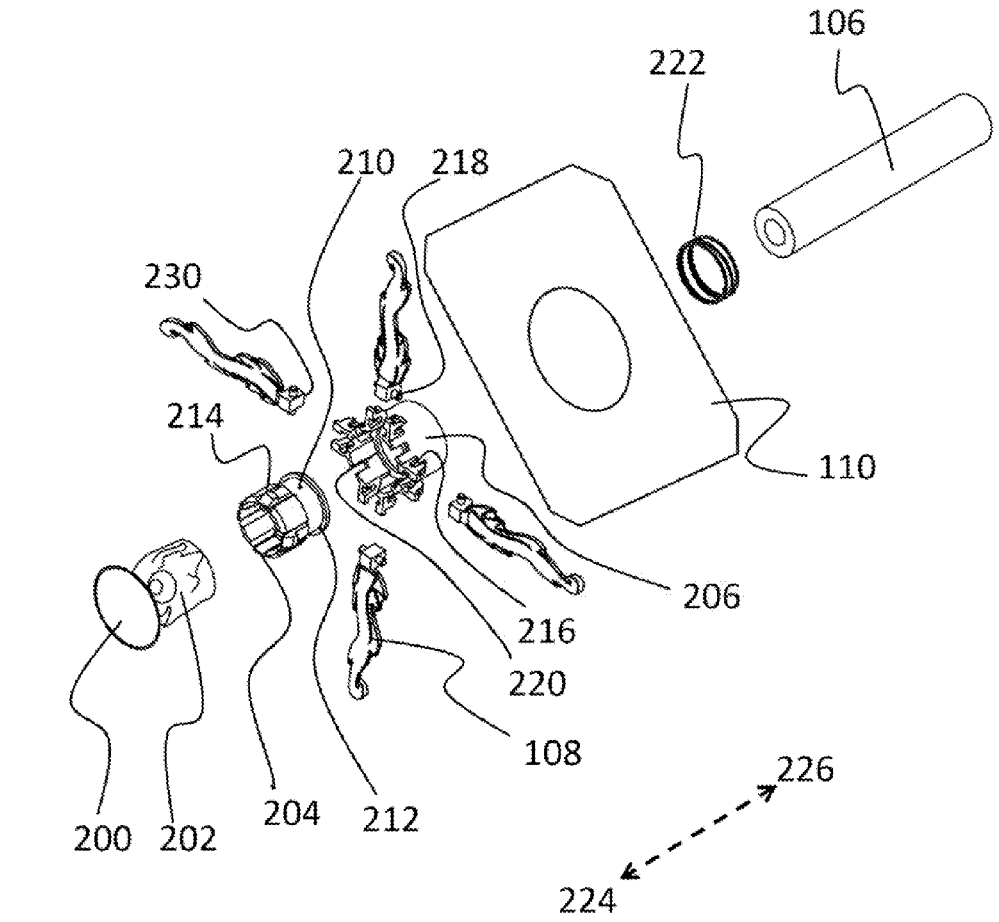
FIG. 2 is an exploded-view illustration of a transforming dart according to the present invention.

FIG. 2 provides an exploded-view illustration for further understanding of the relevant components of the transforming dart 100. As shown, the transforming dart 100 includes a dart body 106. The dart body 106 is any suitable body member that provides for a dart form. As a non-limiting, example, the dart body 106 is a hollow foam, cylindrically-shaped core. On the other end of the dart 100 is the dart tip. The dart tip is formed in any suitable manner to allow the dart 100 to be affixed with a target. As a non-limiting example, the dart tip includes a suction cup 200 affixed (i.e., molded with or separately formed and attached) with a cap member 202. The cap member 202 allows the dart body 106 to be slid therein and, effectively, holds the suction cup 200 to the dart body 106.

The remaining components as depicted in FIG. 2 form the transforming dart mechanism. As illustrated, the transforming dart mechanism includes fins 108 and a deployable canopy 110. As noted above, the fins 108 are pivotally attached with a base. The base is any suitable mechanism or device that allows for deployment of the fins 108 and deployable canopy 110 (or any other suitable expansion member). As a non-limiting example, the base includes an inner collar 204 and an outer collar 206.

Both of the inner collar 204 and outer collar 206 have holes to allow for the dart body 106 to pass therethrough and attach with the cap member 202, thereby affixing the collars 204 and 206 to the dart body 106. The inner collar 204 includes a spring recess 210 that passes around the circumference of the inner collar 204 and that is framed by an inner spring lip 212. The inner collar 204 also includes a plurality of collar knuckles 214 spaced around the periphery of the. collar 204.

Alternatively, the outer collar 206 includes a plurality of fin axle recesses 216. The fin axle recesses 216 are formed to receive and hold protrusions 218 or axles that protrude from the fins 108. Thus, the fins 108 are pivotally attached with the outer collar 206 via the protrusions 218 and fin axle recesses 216. In this aspect, the fins 108 can pivot between the collapsed state (as shown in FIG. 1A) and the expanded state (as shown in FIGS. 1B and 1C).

The outer collar 206 also includes an outer spring lip 220 used to retain the spring 222. Thus, the inner collar 204 can be positioned into and through the outer collar 206, with the spring 222 then positioned around the spring recess 210. Once the inner collar 204 is pressed into outer collar 204 and the spring 222 is positioned around the spring recess 210, the spring 222 is held at a back 226 end by the inner spring lip 212 and held at a front 224 end by the outer lip 220.

It should also be noted that the fins 108 each include fin knuckles 230. The fin knuckles 230 are formed to engage with the collar knuckles 214. Thus, when the fins 108 are folded back 226, the fin knuckles 230 engage with the collar knuckles 214, which forces the outer collar 206 back 226. When the outer collar 206 is forced back 226, it compresses the spring 222.

Although the spring 222 is compressed, it does not possess enough expansion force to cause the fins 108 to deploy on their own. In other words, the fins 108 can be held back 226 on their own when folded against the dart body 106.

Thus, in operation, a user folds the fins 108 against the dart body 106. Once folded, the dart 100 can be positioned in any pneumatically powered dart projection device, such as a toy dart gun, toy dart crossbow, etc. When the dart 100 is shot from the toy dart gun and hits a target, the forward momentum force causes the fins 108 to deploy forward 224. Further, the collar knuckles 214 engage with the fin knuckles 230 which assist the fins 108 in folding out into the expanded state. To deploy rapidly into the expanded state upon impact with the target, the spring 222 is also used to force the outer collar 206 forward 224. As the fins 108 are forced into the expanded state, the deployable canopy 110 expands with the fins 108 to provide a web-like or otherwise fully deployed and expanded state.

Figure 3A:
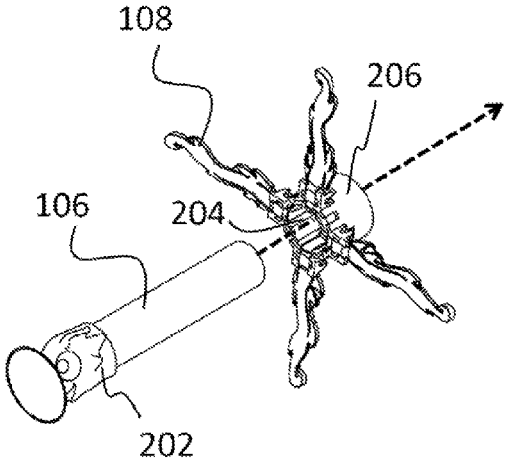
FIG. 3A is an illustration of a transforming dart attachment according to the present invention depicting the attachment with the deployable canopy removed for illustrative purposes.
Figure 3B:
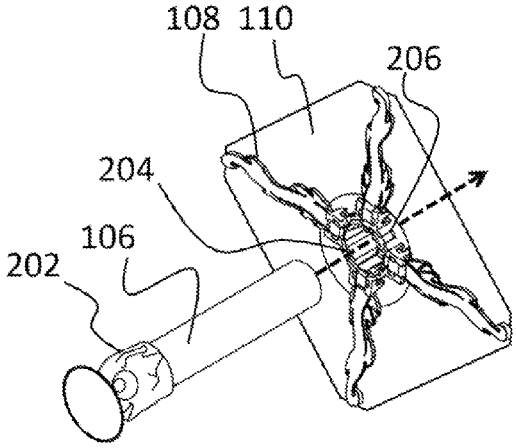
FIG. 3B is an illustration of a transforming dart attachment according to the present invention, depicting the deployable canopy as expanded.

As an alternative to being permanently affixed with the dart body 106 via an adhesive), the transforming dart mechanism can also be a stand-alone item that can be selectively attached with dart body 106. As shown in FIGS. 3A and 3B, the transforming dart mechanism includes a base (e.g., inner and outer collars 204 and 206) and expansion components (e.g., fins 108 and deployable canopy 110). Specifically, FIGS. 3A and 3B illustrate the expansion components in the expanded state, depicting the fins 108 without and with the deployable canopy 110, respectively.

In this aspect, a user can simply slide the dart body 106 through the inner and outer collars 204 and 206 until the dart body 106 comes to rest against the cap member 202. Thus, when the transforming, dart mechanism is a stand-alone unit, it effectively allows a user to convert any standard foam dart into a transforming dart according to the present invention. In either event, the present invention allows for a toy dart that transforms from a collapsed state to an expanded state upon hitting a target.

What is claimed is:

1. A transforming dart mechanism, comprising:

a base adapted to attach with a dart body;

an expansion component connected with the base, the expansion component formed to be positioned in a collapsed state and, upon hitting a. target, moving into an expanded state;

wherein the expansion component includes a plurality of fins that are pivotally connected with the base; and wherein the expansion component further includes a deployable canopy affixed with the plurality of fins.

2. The transforming dart mechanism as set forth in claim 1, wherein the base further comprises:

an inner collar, the inner collar having a hole therethrough to accommodate a dart body, wherein the inner collar further includes a spring recess and a plurality of collar knuckles;

a spring positioned around the spring recess; and an outer collar, the outer collar being positioned around the inner collar, wherein the plurality of fins are pivotally connected with the outer collar.

3. The transforming dart mechanism as set forth in claim 2, wherein each of the plurality of fins includes a fin knuckle, the fin knuckles being formed to engage with the collar knuckles, such that when the fins are folded back into a collapsed state, the fin knuckles engage with the collar knuckles to force the outer collar back, whereby when the transforming dart mechanism is shot from a toy dart gun and hits a target, forward momentum force causes the fins to deploy forward, with the collar knuckles also engaging with the fin knuckles to assist the fins in folding out into the expanded state as the outer collar slides forward.

4. The transforming dart mechanism as set forth in claim 3, further comprising a dart body positioned through the inner collar.

5. The transforming dart mechanism as set forth in claim 4, further comprising a dart tip attached with the dart body, the dart tip having suction cup and a cap member.

6. A transforming dart mechanism, comprising:

a base adapted to attach with a dart body;

an expansion component connected with the base, the expansion component formed to be positioned in a collapsed state and, upon hitting a target, moving into an expanded state;

wherein the expansion component includes a plurality of fins that are pivotally connected with the base; and wherein the base further comprises:

an inner collar, the inner collar having a hole therethrough to accommodate a dart body, wherein the inner collar further includes a spring recess and a plurality of collar knuckles;

a spring positioned around the spring recess; and an outer collar, the outer collar being positioned around the inner collar, wherein the plurality of fins are pivotally connected with the outer collar.

7. The transforming dart mechanism as set forth in claim 6, wherein each of the plurality of fins includes a fin knuckle, the fin knuckles being formed to engage with the collar knuckles, such that when the tins are folded back into a collapsed state, the fin knuckles engage with the collar knuckles to force the outer collar back, whereby when the transforming dart mechanism is shot from a toy dart gun and hits a target, forward momentum force causes the fins to deploy forward, with the collar knuckles also engaging with the fin knuckles to assist the fins in folding out into the expanded state as the outer collar slides forward.

8. The transforming dart mechanism as set forth in claim 6, further comprising a dart body positioned through the inner collar.

9. A transforming dart mechanism, comprising:

a base adapted to attach with a dart body;

an expansion component connected with the base, the expansion component formed to be positioned in a collapsed state and, upon hitting a target, moving into an expanded state; and a dart tip attached with the dart body, the dart tip having suction cup and a cap member.

* * * * *